US007973233B2

(12) United States Patent
Honda et al.

(10) Patent No.: US 7,973,233 B2
(45) Date of Patent: Jul. 5, 2011

(54) MUSICAL TONE CONTROL SYSTEM FOR GRAND-TYPE PIANO

(75) Inventors: Hisamitsu Honda, Hamamatsu (JP); Kenichi Hirota, Hamamatsu (JP); Tetsuya Hirano, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 0 days.

(21) Appl. No.: 12/701,415

(22) Filed: Feb. 5, 2010

(65) Prior Publication Data

US 2010/0236387 A1 Sep. 23, 2010

(30) Foreign Application Priority Data

Mar. 19, 2009 (JP) ..... 2009-068627

(51) Int. Cl.
*G10H 3/06* (2006.01)

(52) U.S. Cl. ..... 84/724; 84/21; 84/719; 84/737

(58) Field of Classification Search ..... 84/724, 84/719, 737, 21
See application file for complete search history.

(56) References Cited

U.S. PATENT DOCUMENTS 5,012,715 A * 5/1991 Matsunaga et al. ..... 84/724
7,432,431 B2 * 10/2008 Hirota et al. ..... 84/462
7,642,448 B2 * 1/2010 Kato ..... 84/724

FOREIGN PATENT DOCUMENTS

JP 3538871 4/2004

* cited by examiner

*Primary Examiner* — Jeffrey Donels
(74) *Attorney, Agent, or Firm* — Christie, Parker & Hale, LLP

(57) ABSTRACT

A musical tone control system for a grand-type piano, which not only enables a shutter to be mounted on a hammer without any inconvenience even when a space above the hammer is small, but also is capable of properly controlling musical tones to be sounded. In this system, first to third optical sensors are disposed along the length of a hammer shank. Depression or non-depress of a key and a pivoting direction of an associated hammer are determined based on signals from the first and second optical sensors, respectively. Further, the pivoting speed of the hammer is calculated based on a signal from the third optical sensor. A musical tone to be sounded is controlled based on the determined depression or non-depression of the key and pivoting direction and the calculated speed of the hammer.

3 Claims, 8 Drawing Sheets

MUSICAL TONE CONTROL SYSTEM FOR GRAND-TYPE PIANO

CROSS-REFERENCE TO RELATED APPLICATION

This application claims priority of Japanese Patent Application Number 068627/2009, filed on Mar. 19, 2009.

BACKGROUND OF THE INVENTION

1. Field of the Invention

The present invention relates to a musical tone control system for a grand-type piano, for use e.g. in a compound piano, such as an electronic piano or a silent piano.

2. Description of the Related Art

As a conventional musical tone control system, there has been known one disclosed in Japanese Patent No. 3538871. The musical tone control system includes shutters each integrally formed on a pivotally movable key, and first and second photointerrupters associated with the key. Each shutter extends downward from the key integrally formed therewith, and has an inverted L shape formed by a rectangular rear half part and a front half part extending forward from an upper portion of the rear half part. The shutter has a window formed in a lower portion of the rear half part. The first and second photointerrupters are each comprised of a pair of a light emitting element and a light receiving element accommodated in a case, and are disposed below the respective rear and front half parts of the shutter.

In a key-released state, the optical paths of the respective first and second photointerrupters are both open. When the key is depressed in this state, the lower end of the rear half part of the shutter reaches the first photointerrupter, whereby the optical path of the first photointerrupter is blocked. When the key further pivotally moves, the lower edge of the window in the rear half part of the shutter reaches the first photointerrupter, whereby the optical path of the first photointerrupter is opened again. When the key pivotally moves further downward, the optical path of the second photointerrupter is blocked by the front half part of the shutter, and then the upper edge of the window in the rear half part of the shutter reaches the first photointerrupter, whereby the optical path of the first photointerrupter is blocked again. When the key is released in this state, the optical paths of the respective first and second photointerrupters are opened and blocked in the reverse order to the above.

The musical tone control system controls sounding of a musical tone based on first and second detection signals from the respective first and second photointerrupters. Specifically, a key depression speed between a time point when the optical path of the first photointerrupter is blocked and a time point when it is blocked again by the upper edge of the window after having been opened by the window is calculated, and the tone volume of the musical tone is set according to the calculated key depression speed. Then, when the optical path of the first photointerrupter is switched from the open state to the blocked state and the optical path of the second photointerrupter is also in the blocked state, sounding of the musical tone is started according to the set tone volume.

As described above, according to the conventional musical tone system, the tone volume of a musical tone and sounding timing for sounding the same are determined according to the blocked or open states of the optical paths of the first and second photointerrupters disposed at different heights. However, when the shutter and the two photointerrupters constructed as above are provided on a hammer side of a grand-type piano, the following problem occurs: While a space between keys and keybed is relatively large, a space above hammers, where pin blocks etc. are provided, is very small. For this reason, during pivotal motion of a hammer, the hammer shank of the hammer can come into contact with the cases accommodating the respective first and second photointerrupters. The problem can be avoided e.g. by disposing the cases at respective higher locations so as to prevent contact of the hammer shank therewith and increasing the length of the shutter. In this case, however, the shutter can come into contact with the pin block during pivotal motion of the hammer.

SUMMARY OF THE INVENTION

It is an object of the present invention to provide a musical tone control system for a grand-type piano, which not only enables a shutter to be mounted on a hammer without any inconvenience even when a space above the hammer is small, but also is capable of properly controlling musical tones to be sounded.

To attain the above object, the present invention provides a musical tone control system for a grand-type piano including a pivotally movable key, and a hammer which has a hammer shank on which a shutter extending in a front-rear direction of the piano and protruding upward is integrally mounted, and performs pivotal motion about a pivot in accordance with depression of the key, comprising a first, a second, and a third optical sensor provided above the hammer and arranged in a direction of the length of the hammer shank, each of which has a light emitting part disposed on one side of a pivotal motion path along which the shutter is pivotally moved, for emitting light, and a light receiving part disposed on the other side of the pivotal motion path, for receiving the light from the light emitting part, and outputs a detection signal indicative of a light receiving state of the light receiving part dependent on whether or not an optical path of the light from the light emitting part is opened or closed by the shutter pivotally moving along the pivotal path, key depression-determining means for determining, based on a detection signal from the first optical sensor, depression or non-depression of the key, pivoting direction-determining means for determining a pivoting direction of the hammer based on a detection signal from the second optical sensor, pivoting speed-calculating means for calculating a pivoting speed of the hammer based on a detection signal from the third optical sensor, and control means for controlling a musical tone to be sounded, based on the determined depression or non-depression of the key and the determined pivoting direction of the hammer, and the calculated pivoting speed of the hammer.

According to this musical tone control system for a grand-type piano, as the hammer pivotally moves about the pivot in accordance with key depression, the optical paths of lights from the light emitting parts of the respective first to third optical sensors are opened and closed by the shutter provided on the hammer shank extending in the front-rear direction, in a manner extending along the length of the hammer shank. A detection signal indicative of the light receiving state of each of the light receiving parts which changes according to the opening or closing of the associated light path, is output from the associated one of the first to third optical sensors. The depression or non-depression of the key is determined based on the detection signal from the first optical sensor of these detection signals, and the pivoting direction of the hammer is determined based on the detection signal from the second optical sensor. Further, the pivoting speed of the hammer is calculated based on the detection signal from the third optical sensor. Then, a musical tone to be sounded is controlled based on the depression or non-depression of the key, and the pivoting direction and speed of the hammer.

If the sounding of a musical tone is controlled only based on the depression or non-depression of a key and the pivoting speed of an associated hammer, there is a fear that some motion of the hammer corresponding to a performer's expression can cause a erroneous determination. For example, a pivotal return motion of the hammer can be erroneously determined as pivotal motion caused by key depression, thereby causing a musical tone to be sounded, in spite of the pivotal return motion of the hammer. According to the present invention, a musical tone is controlled not only based on the depression or non-depression of a key, but also according to the pivoting direction of an associated hammer, which is determined based on the detection signal from the second optical sensor, so that it is possible to properly cause the musical tone to be sounded or stopped according to the pivoting direction of the associated hammer. Thus, the present invention makes it possible to properly control a musical tone to be sounded, based on the depression or non-depression of a key and the pivoting direction and speed of an associated hammer.

Further, the three optical sensors are disposed separately and independently of each other, which contributes to enhancement of the degree of freedom in arrangement of the sensors. This makes it possible to dispose the first to third optical sensors along the length of a hammer shank at respective locations suitable for their functions.

Preferably, the third optical sensor is disposed the remotest of the first to third optical sensors from the pivot.

The pivotal stroke of a hammer through a pivoting angle is larger at a remoter portion of the hammer from the pivot. According to this preferred embodiment, the third optical sensor is disposed the remotest from the pivot of the hammer, so that a large detection section can be secured. This makes it possible to calculate the pivoting speed of the hammer with high accuracy using the detection signal from the third optical sensor and properly control the musical tone based on the calculated pivoting speed.

Preferably, the first optical sensor is disposed the closest of the first to third optical sensors to the pivot.

It is preferred that the depression or non-depression of a key is determined in timing corresponding to a small angle of pivotal motion of an associated hammer from a key-released state. This is because timing in which the key is released is set based on the detection signal indicative of the depression or non-depression of the key, as sounding stop timing for stopping the sounding of a musical tone. According to this preferred embodiment, since the depression or non-depression of the key is determined based on the detection signal from the first optical sensor closest to the pivot, it is possible to properly determine at a small pivotal stroke of the hammer, using a small shutter, whether or not the key has been depressed. Further, since the shutter is small, it is possible to positively prevent the shutter having passed the first optical sensor from abutting against other members disposed above.

What is more, since the third optical sensor is disposed the remotest from the pivot of the hammer, it is possible to obtain the aforementioned advantageous effect and properly determine the pivoting direction of the hammer based on the detection signal from the second optical sensor disposed between the first optical sensor and the third optical sensor.

The above and other objects, features, and advantages of the present invention will become more apparent from the following detailed description taken in conjunction with the accompanying drawings.

DETAILED DESCRIPTION OF PREFERRED EMBODIMENTS

Figure 1:
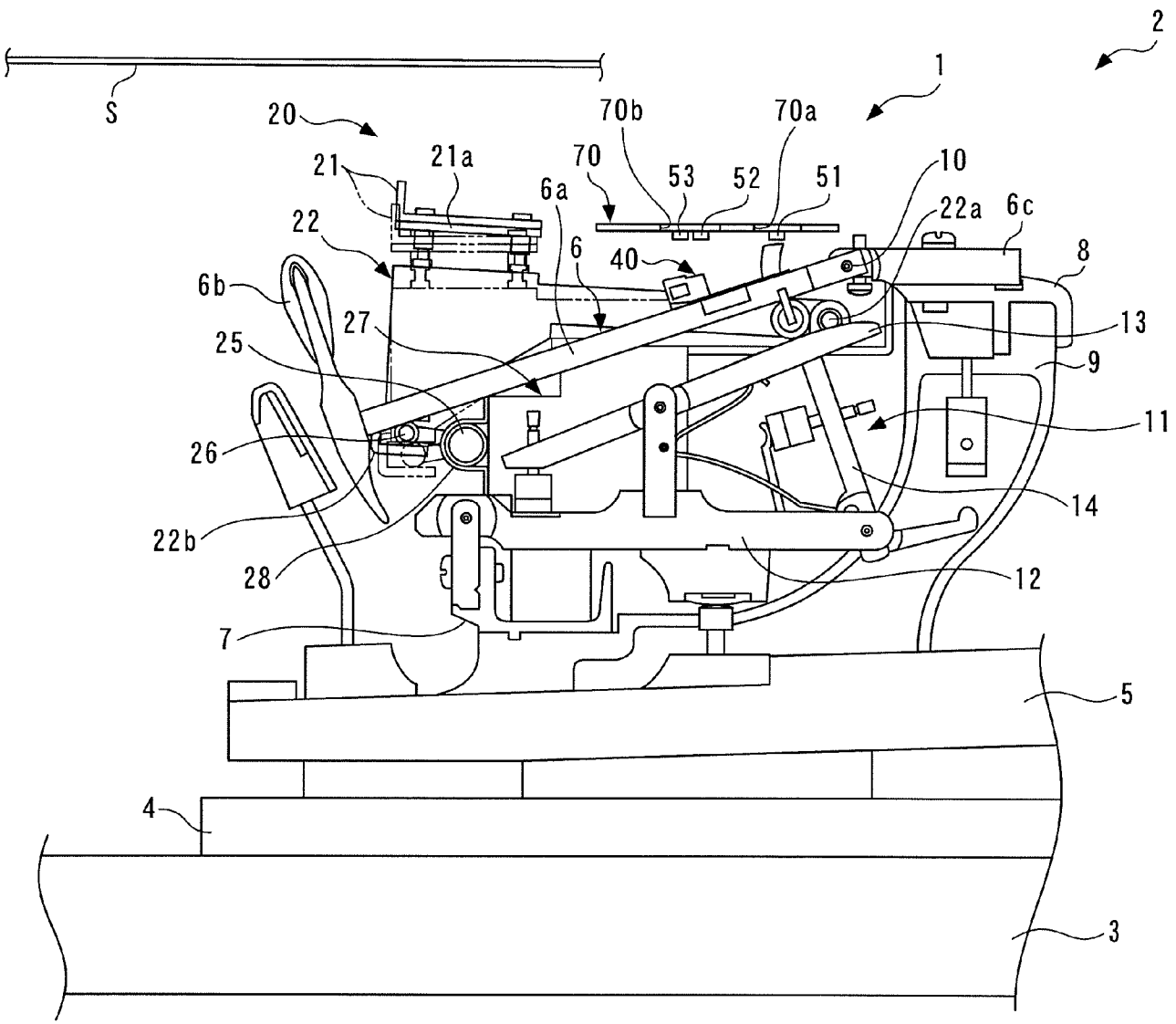
FIG. 1 is a schematic view of a musical tone control system according to an embodiment of the present invention and a silent piano to which the musical tone control system is applied.

The present invention will now be described in detail with reference to the drawings showing a preferred embodiment thereof. FIG. 1 schematically shows a grand-type silent piano 2 to which is applied a musical tone control system 1 according to an embodiment of the present invention. In the following description, a player's side of the silent piano 2 (right side as viewed in FIG. 1) will be referred to as "front", and a remote side (left side as viewed in FIG. 1) from the player's side as "rear". Further, the player's left side will be referred to as "left", and the player's right side as "right".

Figure 5:
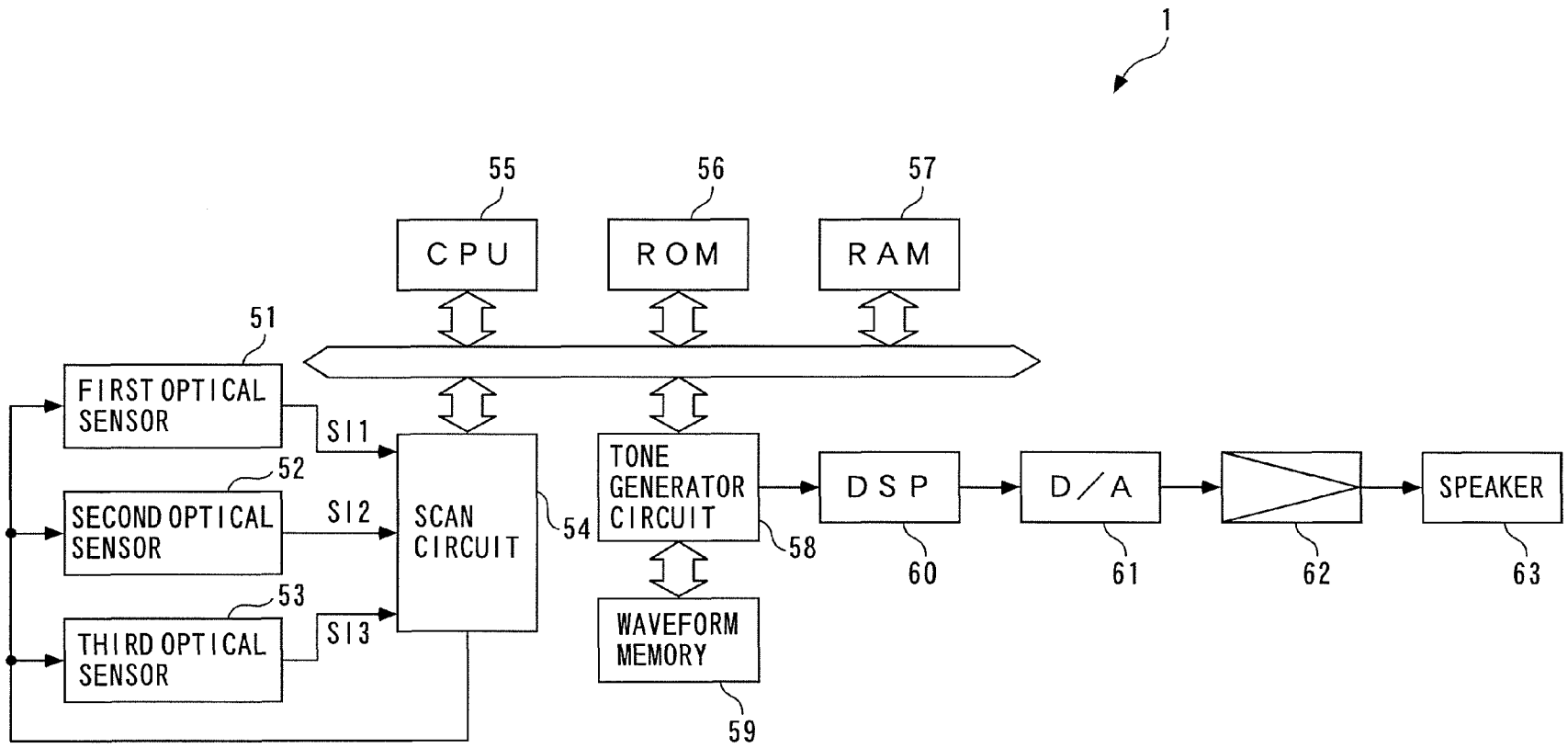
FIG. 5 is a diagram showing part of the musical tone control system.

As shown in FIG. 1, the silent piano 2 is comprised of a plurality of (e.g. eighty-eight) keys 5 (only one of which is shown) mounted on a keybed 3 via a keyframe 4, a hammer 6 provided for each key 5, an action 11 provided above the rear part of the key 5, a muffler mechanism 20, and the musical tone control system 1 (see FIG. 5). In the silent piano 2, the performance mode can be switched between a normal performance mode in which the hammer 6 strikes an associated string S to thereby generate acoustic performance sound, and a silent performance mode in which electronic performance sound is generated in a state where striking of the string by the hammer 6 is inhibited.

The key 5 is pivotally supported by a balance pin (not shown) erected on the keyframe 4, via a balance pin hole (not shown) formed in the center of the key 5.

The action 11 is mounted on a wippen rail 7 and disposed above the rear part of the key 5. The wippen rail 7 extends in the left-right direction along a whole array of the keys 5 through a plurality of brackets 9 (only one of which is shown in FIG. 1) provided at right and left ends and predetermined locations therebetween of the keyframe 4, respectively. Further, the action 11 includes a wippen 12, a repetition lever 13, and a jack 14 for each key 5. The wippen 12 has a rear end thereof pivotally attached to the wippen rail 7 and is placed on the rear part of the key 5. The repetition lever 13 and the jack 14 are pivotally attached to the wippen 12.

The hammer 6 is comprised of a hammer shank **6*a* extending in the front-rear direction and a hammer head 6*b* attached to a rear end of the hammer shank 6*a*. The hammer shank 6*a* of the hammer 6 has a front end thereof pivotally supported by a hammer shank flange 6*c* screwed onto a hammer shank rail 8 via a center pin 10. In a key-released state shown in FIG. 1, the hammer 6 is placed on the repetition lever 13. The hammer shank rail 8 extends in the left-right direction along the whole array of the keys 5 through the aforementioned plurality of brackets 9**.

Figure 2:
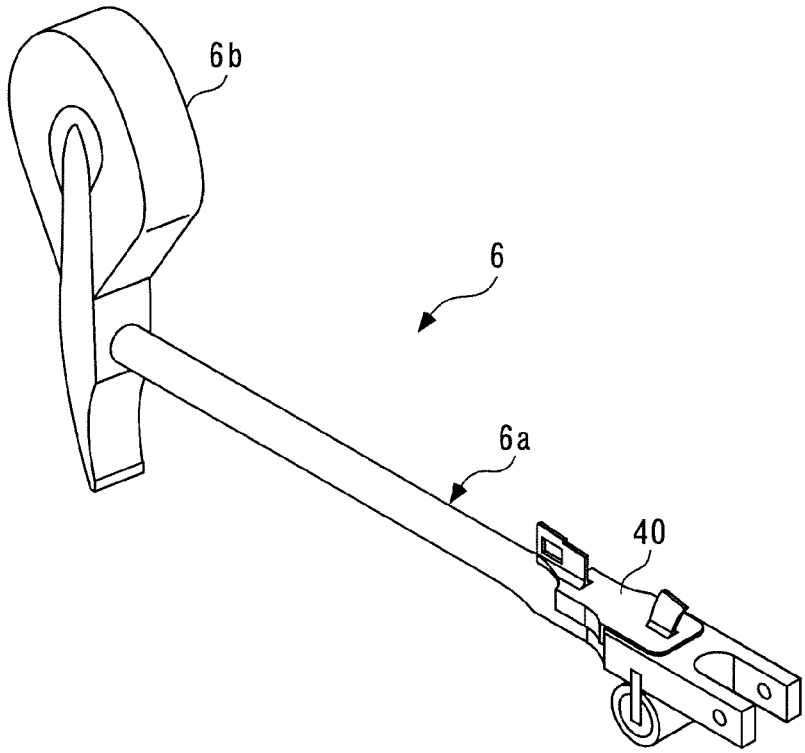
FIG. 2 is a perspective view of a hammer and a shutter.
Figure 3:
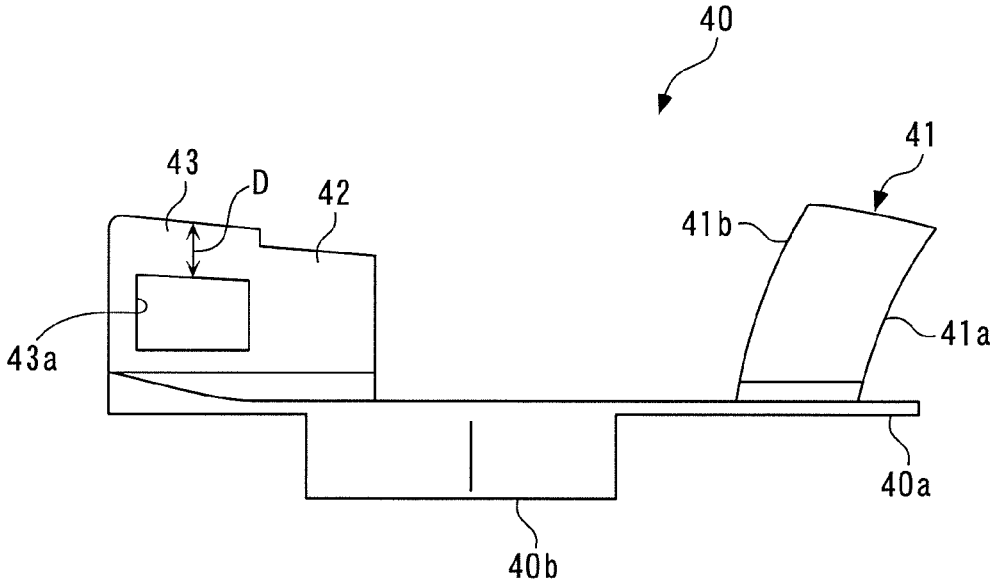
FIG. 3 is a side view of the shutter.

As shown in FIG. 2, a shutter 40 is integrally mounted on the hammer shank 6*a*, and is formed by a molded piece e.g. of a synthetic resin having a light-blocking property. As shown in FIG. 3, the shutter 40 is comprised of a plate-like main body 40*a*, a pair of fitting portions 40*b* and 40*b* extending downward from respective opposite lateral ends of the main body 40*a*, and first to third shutter sections 41 to 43 extending upward from the main body 40*a*.

The pair of fitting portions 40*b* and 40*b* are opposed to each other and are spaced from each other by a distance approximately equal to the width of the hammer shank 6*a*.

The first shutter section 41 is disposed on the front part of the main body 40*a*, and has two arcuate edges i.e. front and rear edges 41*a* and 41*b*. The front edge 41*a* and the rear edge 41*b* extend, respectively, along two arcs which are different in distance from the center pin 10 as their common center, in a manner concentric with each other.

The second and third shutter sections 42 and 43 are disposed on the rear part of the main body 40*a*, and are integrally formed with each other, with the second shutter section 42 positioned in front of the third shutter section 43. Each of the second shutter section 42 and the third shutter section 43 has a rectangular shape, and the third shutter section 43 has a larger height from the main body 40*a* than the second shutter section 42. The third shutter section 43 has a rectangular window 43*a* formed in a central part thereof. The upper edge of the window 43*a* is lower than the upper end of the second shutter section 42.

The shutter 40 constructed as above is mounted on the hammer shank 6*a*, in a state in which the fitting portions 40*b* and 40*b* are fitted on the hammer shank 6*a* and the main body 40*a* is placed on the same.

The muffler mechanism 20 blocks the hammer 6 from striking the string S, when the silent piano 2 is in a silent performance mode. As shown in FIG. 1, the muffler mechanism 20 is comprised of a stopper rail 21, a plurality of rail support members 22 (only one of which is shown in FIG. 1) for supporting the stopper rail 21, a drive rod 25 for driving the stopper rail 21, a plurality of rod support members 27 (only one of which is shown in FIG. 1) for supporting the drive rod 25, and an operation lever (not shown) for driving the drive rod 25.

The stopper rail 21 is formed of a metal plate, and extends in the left-right direction along the whole array of the hammers 6. The stopper rail 21 is disposed between the array of the strings S and that of the hammers 6 in a manner opposed to a rear portion of each hammer shank 6*a*. Further, the stopper rail 21 is divided into a high/mid audio frequency range rail and a low audio frequency range rail. The high/mid audio frequency range rail and the low audio frequency range rail extend along an entire high/mid audio frequency range and an entire low audio frequency range, respectively, and are screwed to the rail support members 22. Attached to the lower surface of the stopper rail 21 except portions opposed to the rail support members 22 are cushion members 21*a* formed of an elastic material, such as rubber or foamed urethane.

The rail support members 22 are disposed at locations corresponding to the respective brackets 9. As shown in FIG. 1, each of the rail support members 22 has a front end thereof pivotally mounted to an associated one of the rod support members 27 via a pin-like pivot 22*a*. With this construction, the rail support member 22 is pivotally movable about the pivot 22*a* along with the stopper rail 21.

The drive rod 25 is formed by a single rod circular in cross section, and extends in the left-right direction along the whole array of the hammers 6. The drive rod 25 has a plurality of L-shaped presser portions 26 (only one of which is shown in FIG. 1) formed at locations corresponding to the respective rail support members 22. Each of the presser portions 26 is engaged with a U-shaped engaging portion 22*b* of the associated rail support member 22.

Similarly to the rail support members 22, the rod support members 27 are disposed at locations corresponding to the respective brackets 9. Each of the rod support members 27 has a front end thereof screwed to the hammer shank rail 8 and a rear end thereof screwed to the wippen rail 7. The rod support member 27 is formed therethrough with a mounting hole (not shown) extending in the left-right direction. The pivot 22*a* of the rail support member 22 is inserted through the mounting hole, whereby the rail support member 22 is pivotally attached to the rod support member 27.

Further, a metal fitting 28 is mounted on the rear end of each rod support member 27, and the drive rod 25 is supported by the rod support members 27 via the metal fittings 28 in a manner rotatable about the axis of the metal fittings 28.

In the muffler mechanism 20 constructed as above, in a case where performance is played in the normal performance mode, the operation lever is held in a non-operating state. In this state, the stopper rail 21 is held in a string strike-permitting position (position indicated by solid lines in FIG. 1) retreated from the range of pivotal motion of the hammer 6.

On the other hand, when the operation lever is operated so as to switch the performance mode from the normal performance mode to the silent performance mode, the drive rod 25 rotates in a counterclockwise direction as viewed in FIG. 1 in accordance with the operation of the operation lever. As a consequence, the presser portions 26 of the drive rod 25 pull the stopper rail 21 downward via the respective rail support members 22, whereby the stopper rail 21 is moved to a string strike-inhibiting position (position indicated by two-dot chain lines in FIG. 1) and held there.

As shown in FIG. 5, the musical tone control system 1 is comprised of first to third optical sensors 51 to 53, a scan circuit 54, a CPU 55, a ROM 56, a RAM 57, a tone generator circuit 58, a waveform memory 59, a DSP 60, a D/A converter 61, a power amplifier 62, and a speaker 63.

Figure 4:
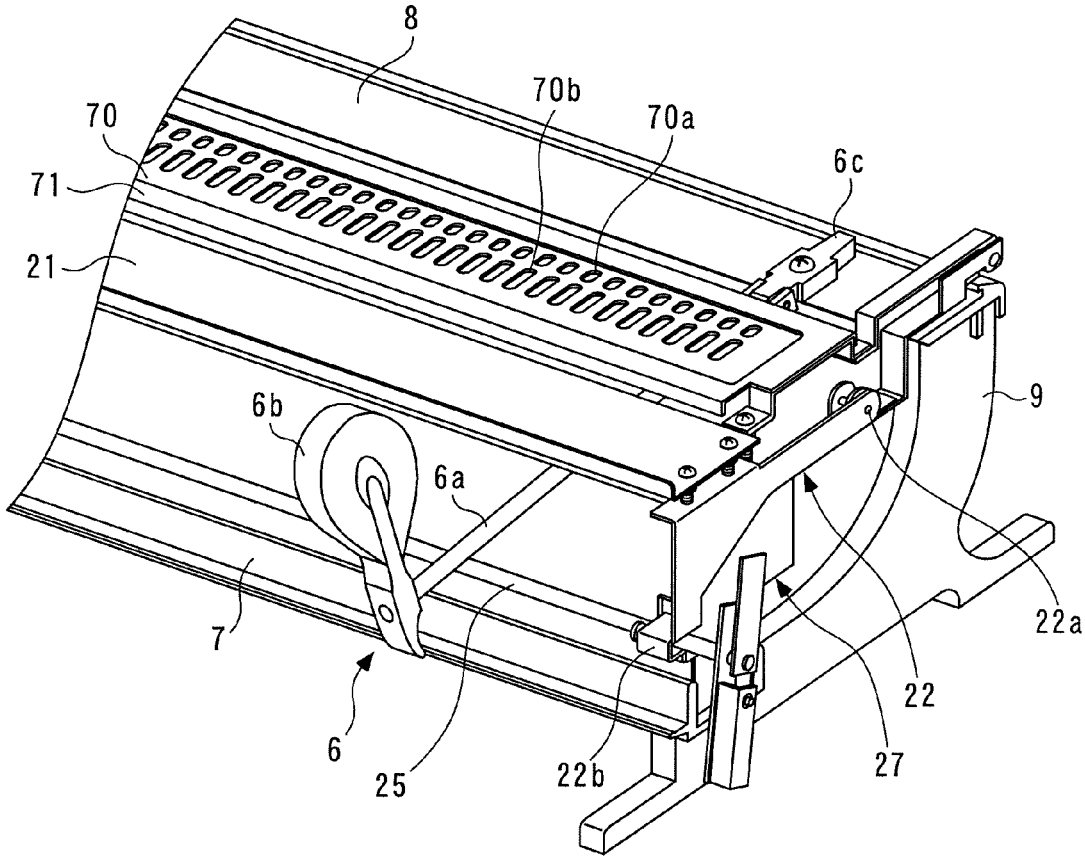
FIG. 4 is a partial perspective view of FIG. 1.

The first to third optical sensors 51 to 53 are mounted on a substrate 70. As shown in FIG. 4, the substrate 70 extends in the left-right direction, and is fitted in an opening (not shown) of a mounting plate 71 and screwed to the same. The mounting plate 71 has a front end thereof pivotally supported by the hammer shank rail 8 and a rear end thereof screwed to the rod support members 27. Thus, the substrate 70 is mounted horizontally in a state covering the front of the hammer shank 6*a* of each of the hammers 6.

The substrate 70 has numerous first shutter passage slots 70*a* each formed at a location corresponding to the first shutter section 41 of the shutter 40 of an associated one of the hammers 6 such that it extends in the front-rear direction and numerous second shutter passage slots 70*b* each formed at a location corresponding to the second and third shutter sections 42 and 43 of the shutter 40 of the associated hammer 6 such that it extends in the front-rear direction. The first shutter section 41 of each shutter 40 passes through an associated one of the first shutter passage slots 70*a*, and the second and third shutter sections 42 and 43 pass through respective associated ones of the second shutter passage slots 70*b*, in accordance with pivotal motion of the associated hammer 6.

Figure 6:
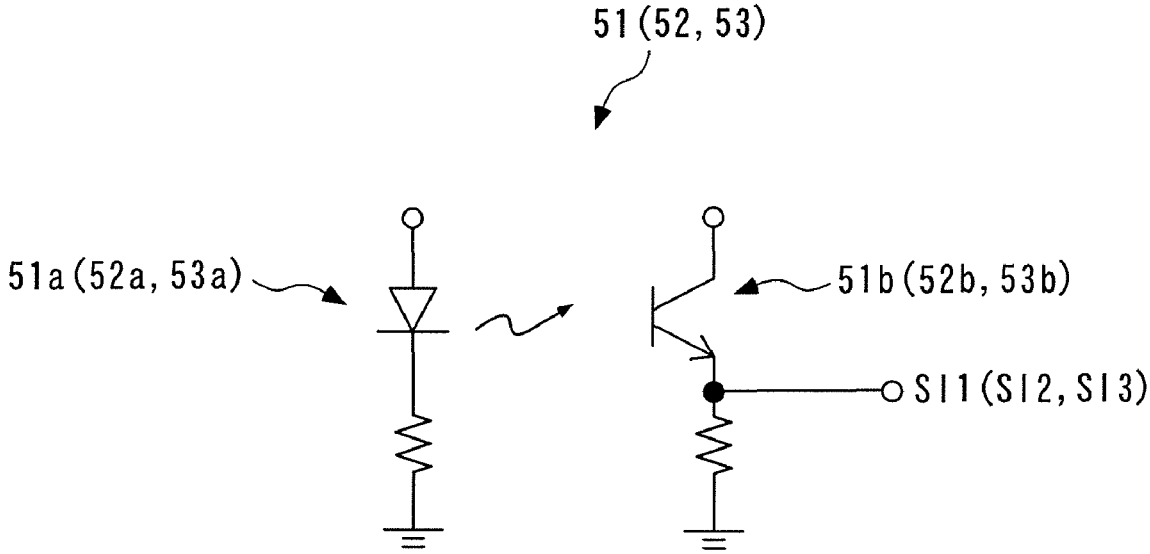
FIG. 6 is a circuit diagram of first to third optical sensors.

The first to third optical sensors 51 to 53 are mounted on the lower surface of the horizontally disposed substrate 70 (see FIG. 1) such that the optical sensors 51 to 53 are arranged at the same height. As shown in FIG. 6, the first to third optical sensors 51 to 53 are implemented by respective photointerrupters identical in construction. The first optical sensor 51 is comprised of a pair of a light emitting diode 51*a* and a phototransistor 51*b* arranged in facing relation to each other in the left-right direction via the associated first shutter passage slot 70*a*. Similarly, the second optical sensor 52 is comprised of a pair of a light emitting diode 52*a* and a phototransistor 52*b* arranged in facing relation to each other in the left-right direction via the front of the associated second shutter passage slot 70*b*, and the third optical sensor 53 is comprised of a pair of a light emitting diode 53*a* and a phototransistor 53*b* arranged in facing relation to each other in the left-right direction via the rear of the associated second shutter passage slot 70*b*.

Each of the light emitting diodes 51*a* to 53*a* is formed by a pn junction diode, and has an anode and a cathode thereof electrically connected to the substrate 70. Each of the light emitting diodes 51*a* to 53*a* is operated when a drive signal is delivered from the CPU 55 to its anode, to emit light from a light emitting surface (not shown) thereof toward the associated one of the phototransistors 51*b* to 53*b* along a horizontal optical path.

Each of the phototransistors 51*b* to 53*b* is formed by a npn junction bipolar transistor, and has a collector and an emitter thereof electrically connected to the substrate 70. Each of the phototransistors 51*b* to 53*b* receives light on a light receiving surface thereof (not shown) as a base, and the collector and the emitter are made conductive therebetween when the amount of light received on the light receiving surface (hereinafter referred to as the "received light amount") is not lower than a predetermined level, whereby a signal of a high level (hereinafter simply referred to as "H") is output from the emitter. On the other hand, when the received light amount is below the predetermined level, the collector and the emitter are made non-conductive therebetween, whereby a signal of a low level (hereinafter simply referred to as "L") is output from the emitter. The first to third optical sensors 51 to 53 output the "H" signal or the "L" signal as first to third detection signals SI1 to SI3, respectively.

With the above arrangement, when the key 5 is depressed, the key 5 pivotally moves about the balance pin in the clockwise direction as viewed in FIG. 1, and in accordance with this pivotal motion, the above-mentioned wippen 12 of the action 11 is pushed up by the key 5. As a consequence, the wippen 12 pivotally moves upward along with the repetition lever 13 and the jack 14, and in accordance with this pivotal motion, the jack 14 pushes up the hammer 6, whereby the hammer 6 performs pivotal motion about the center pin 10 in the clockwise direction. In the normal performance mode, since the stopper rail 21 is in the string strike-permitting position, the hammer head 6*b* of the hammer 6 strikes the string S, whereby acoustic performance sound is generated.

On the other hand, in the silent performance mode, since the stopper rail 21 is in the string strike-inhibiting position, the hammer shank 6*a* comes into abutment with the stopper rail 21 immediately before the hammer head 6*b* strikes the string S, whereby striking of the string S is inhibited for executing performance by electronic sound generated as described hereinafter. In the silent performance mode, in accordance with the pivotal motion of the hammer 6, the shutter 40 opens and closes the optical paths of the respective first to third optical sensors 51 to 53, and in accordance therewith, the first to third detection signals SI1 to SI3 are output to the scan circuit 54.

Figure 7:
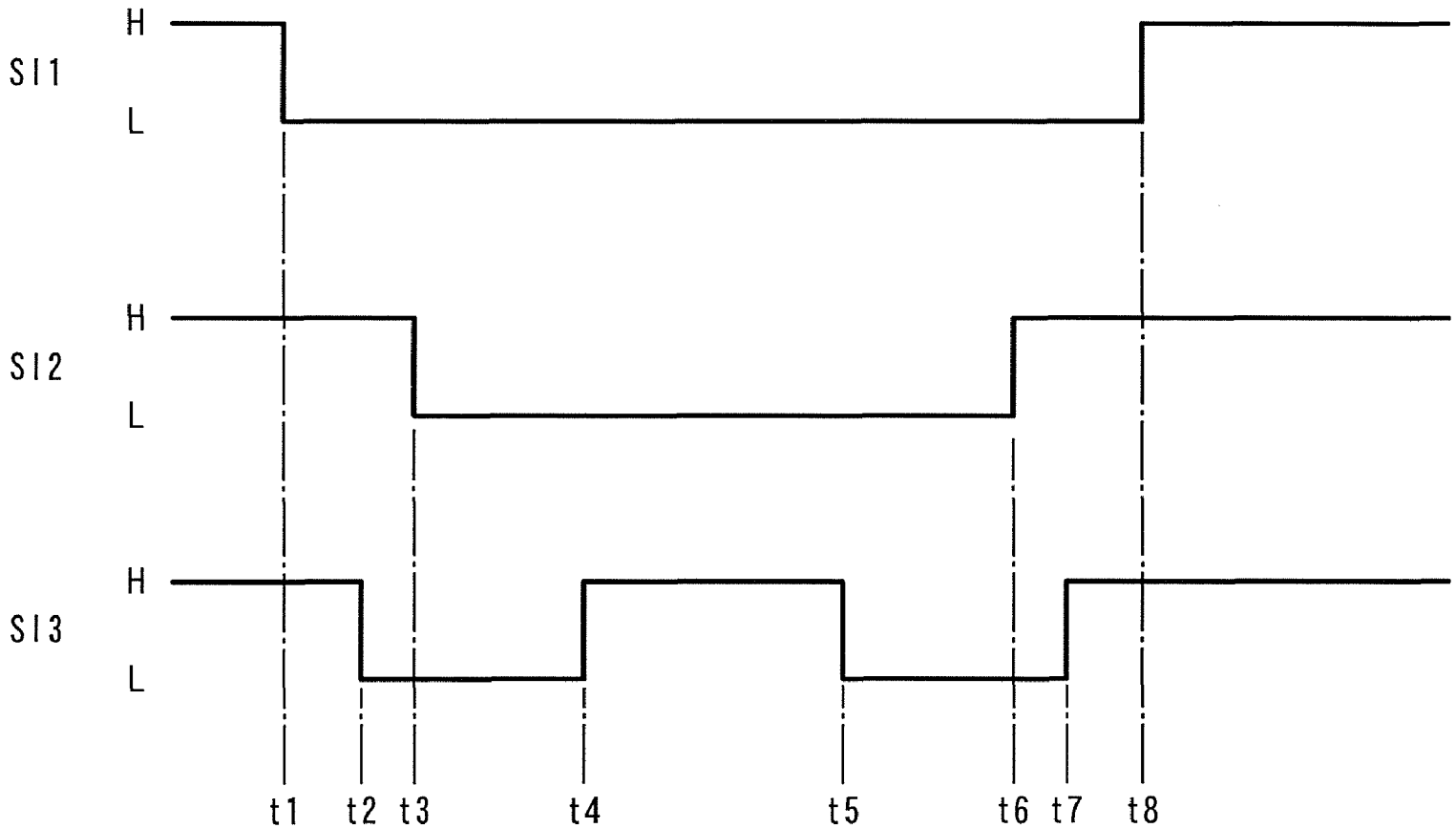
FIG. 7 is a timing diagram showing output states of first to third detection signals output during pivotal motion of the hammer.

FIG. 7 shows the respective output states of the first to third detection signals SI1 to SI3 output in accordance with the pivotal motion of the hammer 6 caused by depression of the key 5. First, in the key-released state, the first to third shutter sections 41 to 43 of the shutter 40 opens the optical paths of the respective first to third optical sensors 51 to 53, whereby the first to third detection signals SI1 to SI3 are all held at "H" (before time t1). Immediately after the key 5 is depressed in this key-released state to cause the pivotal motion of the hammer 6 in the clockwise direction as viewed in FIG. 1, the upper end of the first shutter section 41 of the shutter 40 reaches the first optical sensor 51, whereby the optical path of the same is blocked and the first detection signal SI1 falls from "H" to "L" (t1). When the hammer 6 further moves upward, the upper end of the third shutter section 43 of the shutter 40 reaches the optical path of the third optical sensor 53, whereby the third detection signal SI3 falls from "H" to "L" (t2). When the hammer 6 further moves upward, the upper end of the second shutter section 42 of the shutter 40 reaches the optical path of the second optical sensor 52, whereby the second detection signal SI2 falls from "H" to "L" (t3). When the hammer 6 further moves upward, the upper edge of the window 43*a* of the third shutter section 43 of the shutter 40 reaches the optical path of the third optical sensor 53 near a location where the hammer shank 6*a* is brought into abutment with the stopper rail 21, whereby the optical path of the third optical sensor 53 is opened to cause the third detection signal SI3 to rise from "L" to "H" (t4).

Thereafter, when the hammer 6 further moves upward, the hammer shank 6*a* is brought into abutment with the stopper rail 21, whereby the hammer 6 starts pivotal return motion in the counterclockwise direction as viewed in FIG. 1. During this pivotal return motion, the upper edge of the window 43*a* of the third shutter section 43 of the shutter 40 reaches the optical path of the third optical sensor 53, whereby the optical path of the third optical sensor 53 is blocked and the third detection signal SI3 falls from "H" to "L" (t5). When the pivotal return motion further advances, the second shutter section 42 of the shutter 40 passes the second optical sensor 52, whereby the second detection signal SI2 rises from "L" to "H" (t6). When the pivotal return motion further advances, the third shutter section 43 of the shutter 40 passes the third optical sensor 53, whereby the third detection signal SI3 rises from "L" to "H" (t7). Then, immediately before the hammer 6 returns to its key-released position, the first shutter section 41 of the shutter 40 passes the first optical sensor 51, whereby the first detection signal SI1 rises from "L" to "H" (t8). Thereafter, the key 5 and the hammer 6 returns to their key-released positions.

The scan circuit 54 detects ON/OFF information of a key 5 and key number information for identifying the key 5 turned on or off, based on the first to third detection signals SI1 to SI3 output from the associated first to third optical sensors 51 to 53, and outputs the ON/OFF information and the key number information to the CPU 55 together with the first to third detection signals SI1 to SI3, as key depression information data of the key 5.

The ROM 56 stores not only control programs to be executed by the CPU 55, but also fixed data for controlling tone volume and so forth. The RAM 57 not only temporarily stores status information indicative of an operational status of the silent piano 2, and other information, but also is used as a work area for the CPU 55.

The tone generator circuit 58 reads out sound source waveform data and envelope data from the waveform memory 59 according to a control signal from the CPU 55, and adds the envelope data to the read-out sound source waveform data to thereby generate a musical tone signal as an original tone. The DSP 60 imparts a predetermined acoustic effect to the musical tone signal generated by the tone generator circuit 58. The D/A converter 61 converts the musical tone signal having the acoustic effect imparted thereto by the DSP 60, from digital to analog. The power amplifier 62 amplifies the analog signal obtained through the conversion, by a predetermined gain, and the speaker 63 reproduces the amplified analog signal and outputs the reproduced analog signal as an electronic musical tone.

The CPU 55 executes a sounding control process including processes for determining sounding timing and sounding stop timing and setting tone volume, according to the first to third detection signals SI1 to SI3 from the first to third optical sensors 51 to 53. It should be noted that in the present embodiment, the CPU 55 corresponds to key depression-determining means, pivoting direction-determining means, pivoting speed-calculating means, and control means.

Figure 8:
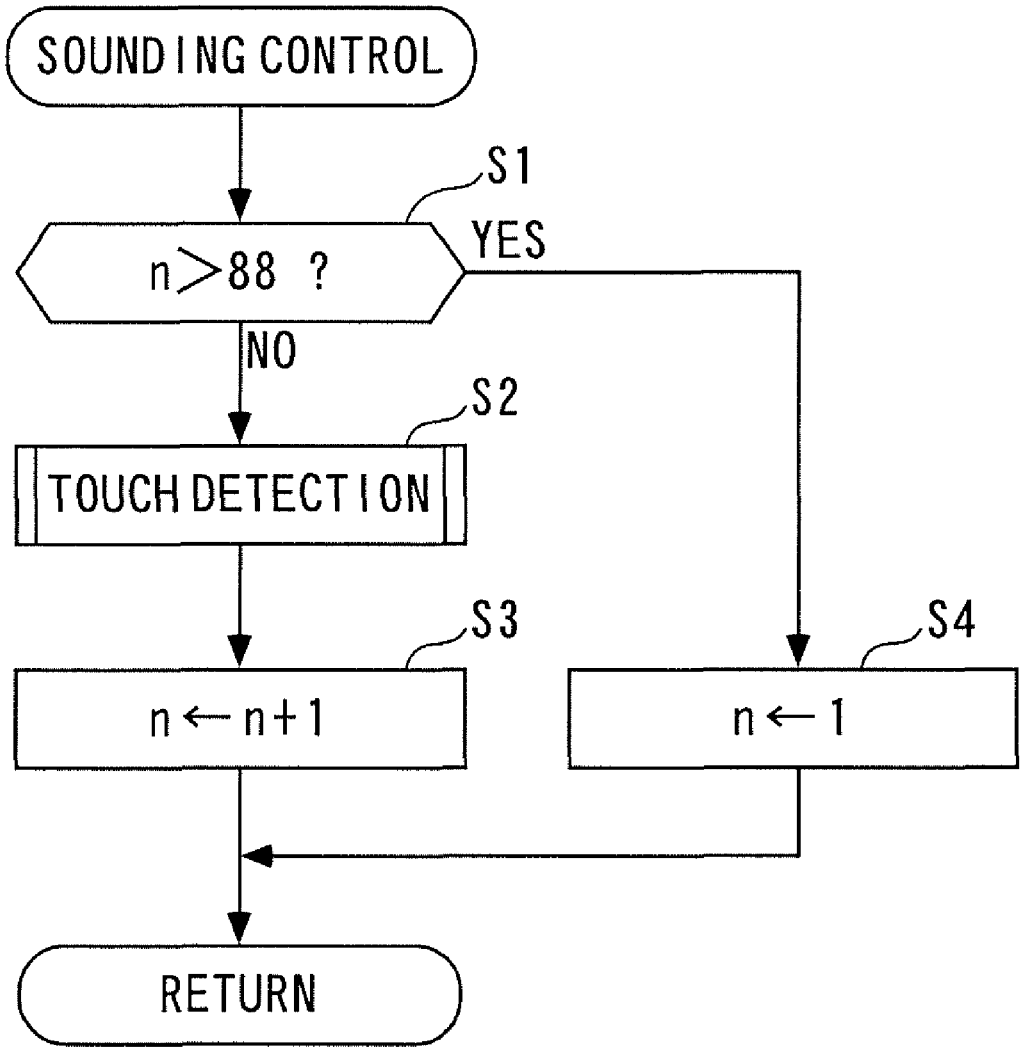
FIG. 8 is a flowchart of a sounding control process executed by a CPU appearing in FIG. 5.

FIG. 8 is a flowchart of the sounding control process executed by the CPU 55. The present process is executed sequentially for all the eighty-eight keys 5. In the present process, first, in a step 1 (shown as S1 in abbreviated form in FIG. 8; the following steps are also shown in abbreviated form), it is determined whether or not the value of a key number n (n=1 to 88) indicative of a key 5 is larger than a value of 88. The key numbers n are serial numbers assigned to the respective keys 5 arranged in order from the lowest-pitch tone to the highest-pitch tone. The key number "1" is assigned to the lowest-pitch key 5, and the key number "88" to the highest-pitch key 5.

If the answer to the question of the step 1 is negative (NO), a touch detection process including detection of sounding timing and sounding stop timing associated with the present key number n is executed (step 2). Then, the key number n is incremented (step 3), followed by terminating the sounding control process.

On the other hand, if the answer to the question of the step 1 is affirmative (YES), it is determined that the touch detection process has been completely executed for all the eighty-eight keys, and the key number n is initialized to a value of 1 (step 4), followed by terminating the sounding control process.

Figure 9:
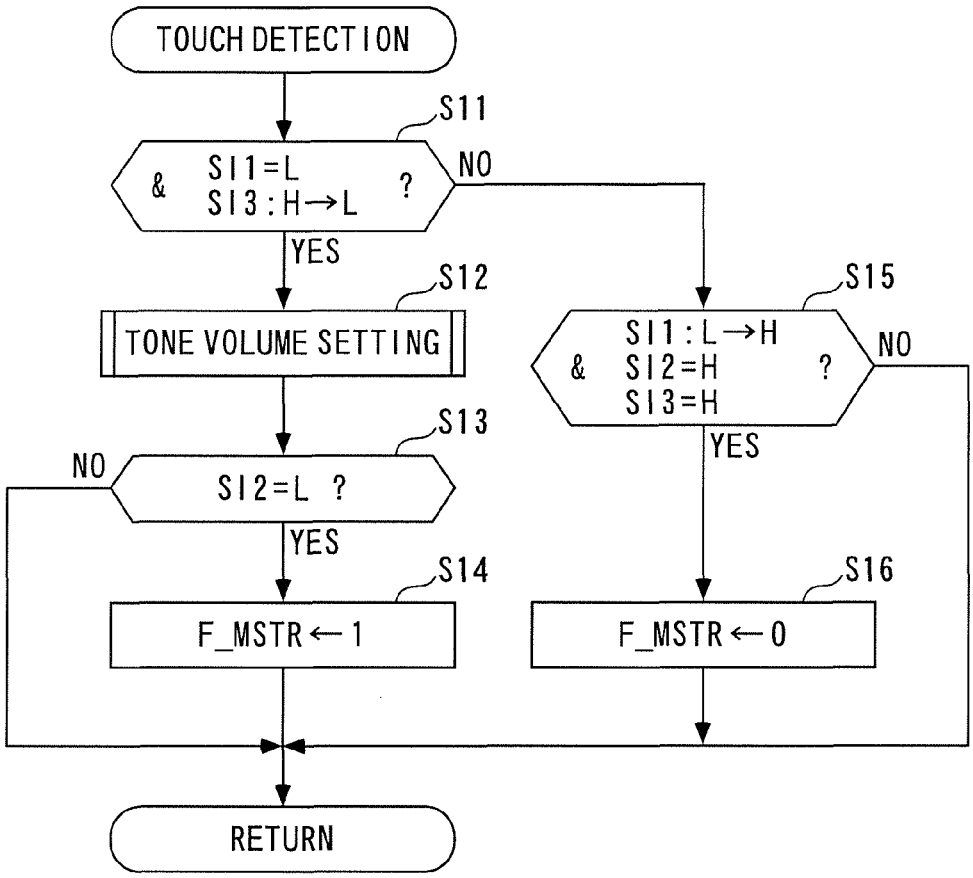
FIG. 9 is a flowchart of a subroutine showing a touch detection process.

The touch detection process is executed according to a subroutine shown in FIG. 9. In the present process, first, it is determined in a step 11 whether or not the first detection signal SI1 from the first optical sensor 51 is at "L" and the third detection signal SI3 from the third optical sensor 53 has changed from "H" to "L" between the immediately preceding loop and the present loop. If the answer to the question is affirmative (YES), i.e. if it is time immediately after the optical path of the third optical sensor 53 has been blocked by the third shutter section 43 (t2 or t5 in FIG. 7), the tone volume setting process is executed (step 12).

Figure 10:
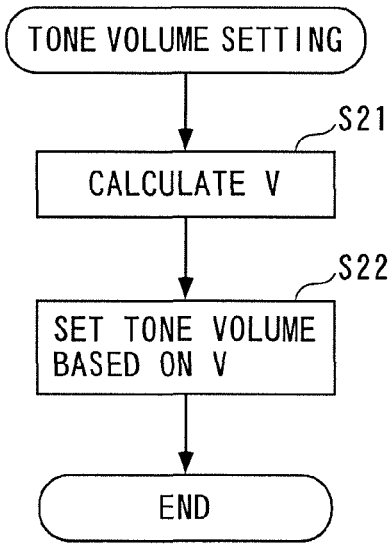
FIG. 10 is a flowchart of a subroutine showing a tone volume setting process.

The tone volume setting process is executed according to a subroutine shown in FIG. 10. In the present process, first, a velocity V as the pivoting speed of the hammer 6 is calculated in a step 21. Specifically, first, a time period from a time point when the third detection signal SI3 fell to "L" to a time point when the same rose to "H" (i.e. a time period between t2 and t4 or t5 and t7 in FIG. 7) is calculated. Next, the velocity V is obtained by dividing a length D (see FIG. 3) of a portion of the third shutter section 43 above the window 43*a* by the calculated time period. Then, the tone volume is set based on the calculated velocity V (step 22), followed by terminating the tone volume setting process.

Referring again to FIG. 9, in a step 13 following the step 12, it is determined whether or not the second detection signal SI2 is at "L". If the answer to the question is affirmative (YES), it is determined that the hammer 6 is pivotally moving toward the string S in accordance with key depression (t4 in FIG. 7), and a sounding flag F_MSTR is set to "1" (step 14), followed by terminating the touch detection process. When the sounding flag F_MSTR is set to "1", a control signal for starting sounding is output to the tone generator circuit 58, whereby tone sounding based on the determined tone volume is started.

On the other hand, if the answer to the question of the step 13 is negative (NO), it is determined that the hammer 6 is performing pivotal return motion in an opposite direction from the string S (t7 in FIG. 7), and the present process is immediately terminated. Thus, re-sounding of the musical tone is inhibited.

If the answer to the question of the step 11 is negative (NO), it is determined whether or not the first detection signal SI1 changed from "L" to "H" between the immediately preceding loop and the present loop and the second and third detection signals SI2 and SI3 are both at "H" (step 15). If the answer to the question is negative (NO), the present process is immediately terminated.

On the other hand, if the answer to the question of the step 15 is affirmative (YES), i.e. if it is time immediately after the first shutter section 41 passed the first optical sensor 51 in accordance with the pivotal return motion of the hammer 6 (t8 in FIG. 7), it is determined that it is time to stop sounding of the musical tone, and the sounding flag F_MSTR is reset to "0" (step 16), followed by terminating the present process. As a consequence, a control signal for stopping sounding of the musical tone is output to the tone generator circuit 58, whereby musical tone sounding is stopped.

As described above, according to the present embodiment, the first to third optical sensors 51 to 53 are arranged in the front-rear direction at the same height, and therefore it is possible to mount the shutter 40 on the hammer shank 6*a* such that even when a space above the hammer 6 is small, the hammer 6 can perform pivotal motion without bringing the hammer shank 6*a* into contact with any of the first to third optical sensors 51 to 53 or bringing the shutter 40 having passed the respective first to third optical sensors 51 to 53 into contact with a portion of the piano body above the shutter 40.

Further, since the first detection signal SI1 from the first optical sensor 51 closest to the center pin 10 is used to determine whether or not a key 5 has been depressed, it is possible to perform proper determination as to the depression or non-depression of the key 5 using the small first shutter section 41, i.e. by a small pivotal stroke. Furthermore, since the first shutter section 41 is small, it is possible to reliably prevent the shutter 40 having passed the first optical sensor 51 from abutting against other members disposed above the shutter 40.

Moreover, since the third optical sensor 53 is disposed remotest from the center pin 10, a larger detection section can be secured, which makes it possible to accurately calculate the velocity V using the third detection signal SI3.

In addition, since a musical tone is controlled not only according to determination as to the depression or non-depression of the key 5 based on the first detection signal SI1, but also according to the pivoting direction of the hammer 6 based on the second detection signal SI2, it is possible to properly determine sounding timing and sounding stop timing corresponding to the pivoting direction of the hammer 6.

Thus, a musical tone to be sounded can be controlled properly based on determination as to the depression or non-depression of a key 5, the pivoting direction of the associated hammer 6, and the velocity V.

It should be noted that the present invention is by no means limited to the embodiment described above, but it can be practiced in various forms. For example, although in the present embodiment, the first to third optical sensors 51 to 53 are arranged at the same height, this is not limitative, but they may be arranged obliquely in the front-rear direction. In this case, it is preferred that the first to third optical sensors 51 to 53 are arranged at respective locations which become higher toward the location of the third optical sensor 53. More specifically, it is preferred that the first to third optical sensors 51 to 53 are arranged such that they are positioned in parallel relation to the hammer shank immediately before the hammer strikes the string. This makes it possible to reliably prevent the hammer shank from coming into contact with any of the first to third optical sensors during pivotal motion of the hammer, and the shutter having passed the first to third optical sensors 51 to 53 from abutting against other members disposed above the shutter.

Further, although in the present embodiment, each optical sensor is implemented by a photointerrupter comprised of a light emitting diode and a phototransistor, another suitable type of optical sensor may be employed. For example, the optical sensor may have a light emitting part formed e.g. by a laser diode and a light receiving part formed e.g. by a photodiode.

Furthermore, although in the present embodiment, the present invention is applied to the silent piano, by way of example, this is not limitative, but the present invention can be applied to other types of keyboard instruments, such as an automatic performance piano and an electronic piano.

It is further understood by those skilled in the art that the foregoing are preferred embodiments of the invention, and that various changes and modifications may be made without departing from the spirit and scope thereof.

What is claimed is:

1. A musical tone control system for a grand-type piano including a pivotally movable key, and a hammer which has a hammer shank on which a shutter extending in a front-rear direction of the piano and protruding upward is integrally mounted, comprising:

a first, a second, and a third optical sensor provided above the hammer and arranged in a direction of the length of the hammer shank, each of which has a light emitting part disposed on one side of a pivotal motion path along which the shutter is pivotally moved, for emitting light;

a light receiving part disposed on another side of the pivotal motion path for receiving the light from the light emitting parts, and outputting a detection signal indicative of a light receiving state of the light receiving parts dependent on whether or not an optical path of the light from each of the light emitting parts is opened or closed by the shutter pivotally moving along the pivotal path;

key depression-determining means for determining, based on a detection signal from said first optical sensor, depression or non-depression of the key;

pivoting direction-determining means for determining a pivoting direction of the hammer based on a detection signal from only said second optical sensor;

pivoting speed-calculating means for calculating a pivoting speed of the hammer based on a detection signal from only said third optical sensor; and control means for controlling a musical tone to be sounded, based on the determined depression or non-depression of the key and the determined pivoting direction of the hammer, and the calculated pivoting speed of the hammer.

2. The musical tone control system according to claim 1, wherein said third optical sensor is disposed as a remotest of said first to third optical sensors from the pivot.

3. The musical tone control system according to claim 1, wherein said first optical sensor is disposed as a closest of said first to third optical sensors to the pivot.

* * * * *